US009460672B2

(12) United States Patent
Shang et al.

(10) Patent No.: US 9,460,672 B2
(45) Date of Patent: Oct. 4, 2016

(54) METHOD FOR DRIVING A LIQUID CRYSTAL DISPLAY PANEL AND LIQUID CRYSTAL DISPLAY

(71) Applicant: BOE Technology Group Co., Ltd., Beijing (CN)

(72) Inventors: Guangliang Shang, Beijing (CN); Lilei Zhang, Beijing (CN)

(73) Assignee: BOE Technology Group Co., Ltd., Beijing (CN)

( * ) Notice: Subject to any disclaimer, the term of this patent is extended or adjusted under 35 U.S.C. 154(b) by 217 days.

(21) Appl. No.: 14/103,234

(22) Filed: Dec. 11, 2013

(65) Prior Publication Data

US 2014/0160382 A1 Jun. 12, 2014

(30) Foreign Application Priority Data

Dec. 12, 2012 (CN) ..... 2012 1 0537755

(51) Int. Cl.
*G09G 3/36* (2006.01)
*G09G 3/00* (2006.01)

(52) U.S. Cl.
CPC ..... *G09G 3/3648* (2013.01); *G09G 3/3607* (2013.01); *G09G 3/003* (2013.01); *G09G 3/3614* (2013.01); *G09G 2300/0452* (2013.01)

(58) Field of Classification Search
CPC ..... G09G 3/3607; G09G 3/3614; G09G 3/3648; G09G 3/003; G09G 2300/0452
USPC ..... 345/87–104
See application file for complete search history.

(56) References Cited

U.S. PATENT DOCUMENTS 8,421,709 B2 4/2013 Kang
2011/0128269 A1* 6/2011 Lee ..... G02B 27/26 345/211

FOREIGN PATENT DOCUMENTS

CN 101867836 A 10/2010
KR 20120076209 A 7/2012

OTHER PUBLICATIONS

Machine English Translation for Foreign Patent Document KR 20120076209 A, Sep. 2, 2015, pp. 1-25.*
First Chinese Office Action for Chinese Patent Application No. 201210537755.6, dated Sep. 29, 2014, 17 pages.

* cited by examiner

*Primary Examiner* — Jimmy H Nguyen
(74) *Attorney, Agent, or Firm* — Westman, Champlin & Koehler, P.A.

(57) ABSTRACT

The present invention provides a method for driving a liquid crystal display panel and a liquid crystal display so that the power consumption for driving a 3D liquid crystal display panel can be reduced. The method includes steps of: determining that it is needed to input data to the black matrix sub-pixels when displaying a 3D image; and inputting a control signal to a 3D black screen data control module, the 3D black screen data control module, based on the received control signal, makes two data lines which are connected therewith and are of opposite polarities be electrically conducted.

8 Claims, 7 Drawing Sheets

METHOD FOR DRIVING A LIQUID CRYSTAL DISPLAY PANEL AND LIQUID CRYSTAL DISPLAY

CROSS-REFERENCE TO RELATED APPLICATION

This application claims the benefit of Chinese Patent Application No. 201210537755.6 filed on Dec. 12, 2012 in the State Intellectual Property Office of China, the whole disclosure of which is incorporated herein by reference.

BACKGROUND OF THE INVENTION

1. Field of the Invention

The present invention relates to liquid crystal display techniques, and more particularly, to a method for driving a liquid crystal display panel, and a liquid crystal display.

2. Description of the Related Art

In existing liquid crystal display devices, in order to avoid a direct current (DC) blocking effect and reduce DC residue, positive and negative polarities are generally reversed for driving of liquid crystal. There are existing ways for reversing pixel array polarities, including frame reversal, row reversal, column reversal and dot reversal. In column reversal and dot reversal ways, polarities of charges on adjacent data lines connected by the same row of pixels are reversed.

One of existing polarized 3D (Three Dimensions) liquid crystal displays includes a liquid crystal display panel, a drive module and a pattern retarder.

The pattern retarder is arranged in front of the display panel and divides light from the display panel into a first polarized light and a second polarized light in a 3D mode, and thus is an important member for achieving a 3D visual effect.

The liquid crystal display panel is different from that of the conventional 2D (Two Dimensions) liquid crystal display in pixel structures. Specifically, in the liquid crystal display panel, initial rows of R (Red), G (Green) and B (Blue, B) basic pixels are re-divided into two rows, pixels in one of which are designed to be used as sub-pixels for a variable black matrix (referred herein to as black matrix sub-pixels, while initial pixels for normal display are referred to as color sub-pixels). As shown in FIG. 1, the sub-pixels in the variable black matrix can be used such that their arrangements are continuous within a row, wherein G1,G1*a*,G2,G2*a* are gate lines, regions between G1 and G1*a*, and between G2 and G2*a* are pixel regions for the variable black matrix (black matrix, BM); a pixel arrangement similar to that of the 2D display panel can also be used, as shown in FIG. 2, wherein G1 and G1*a* are gate lines, and sub-pixels between G1 and G1*a* are used as BM and are connected with the data line of the column respectively The drive module scans the gate line in a line-by-line manner, but there are two working modes, that is, 2D mode and 3D mode, when inputting image data, and the data signals inputted to the pixels are different under different driving modes. In the 2D mode, the black matrix sub-pixels are input brightness compensation data to increase brightness of displaying images under the 2D mode; in the 3D mode, the black matrix sub-pixels are input black screen data and are used the variable black matrix to obtain a larger 3D view angle for the display.

At time of displaying a 3D image, when each row of pixels of the polarized 3D liquid crystal display is scanned, the data line needs to provide a different voltage from that for scanning a previous row, so that larger power consumption may be needed to change data line voltage directly.

SUMMARY OF THE INVENTION

Embodiments of the present invention provide a method for driving a liquid crystal display panel and a liquid crystal display so that the power consumption for driving a 3D liquid crystal display panel can be reduced.

Embodiments of the present invention provide a method for driving a liquid crystal display panel, the liquid crystal display panel including a plurality of rows of basic pixels, a plurality of rows of gate lines, a plurality of data lines arranged in columns, and a 3D black screen data control module, wherein each row of basic pixels is divided into a row consisting of black matrix sub-pixels and a row consisting of color sub-pixels, both the black matrix sub-pixels and the color sub-pixels are connected with corresponding column of data lines and corresponding gate lines, and the 3D black screen data control module is connected between two data lines, wherein, when displaying a 3D image, the method includes steps of:

determining that it is needed to input data to the black matrix sub-pixels; and inputting a control signal to the 3D black screen data control module, the 3D black screen data control module, based on the received control signal, making the two data lines, which are connected therewith and are of opposite polarities, be electrically conducted.

Embodiments of the present invention provide a liquid crystal display including a liquid crystal display panel, the liquid crystal display panel includes: a plurality of rows of gate lines; a plurality of data lines arranged in columns; a plurality of rows of basic pixels, wherein each row of basic pixels is divided into a row consisting of black matrix sub-pixels and a row consisting of color sub-pixels, both the black matrix sub-pixels and the color sub-pixels are connected with corresponding column of data lines and corresponding gate lines; and a 3D black screen data control module, the 3D black screen data control module is connected between two data lines, and, based on a received control signal, makes the two data lines, which are connected therewith and are of opposite polarities, be electrically conducted.

BRIEF DESCRIPTION OF THE DRAWINGS

The above and other features of the present invention will become more apparent by describing in detail exemplary embodiments thereof with reference to the accompanying drawings, in which.

DETAILED DESCRIPTION OF PREFERRED EMBODIMENTS OF THE INVENTION

Figure 1:
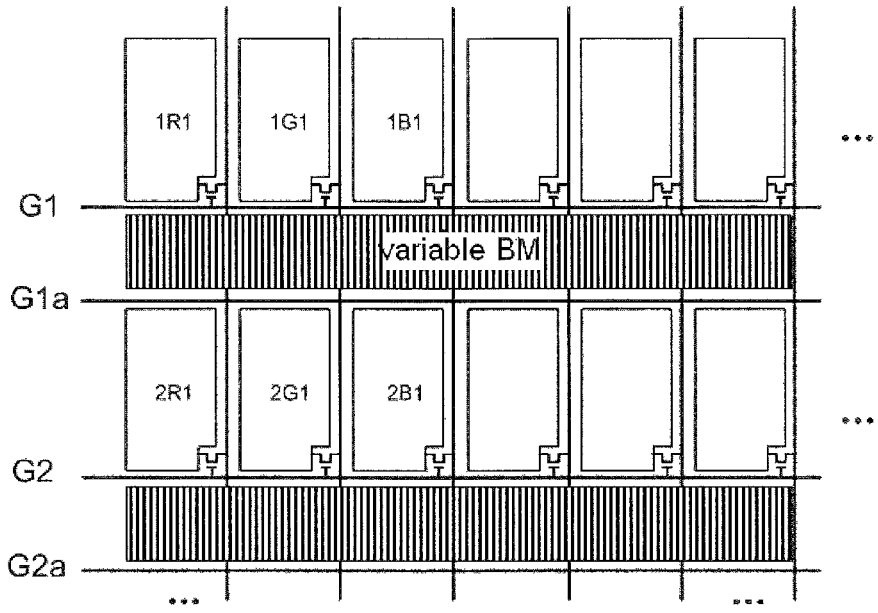
Fig. 1 (Prior Art)
FIG. 1 is a structural diagram of a liquid crystal display panel in prior arts.
Figure 2:
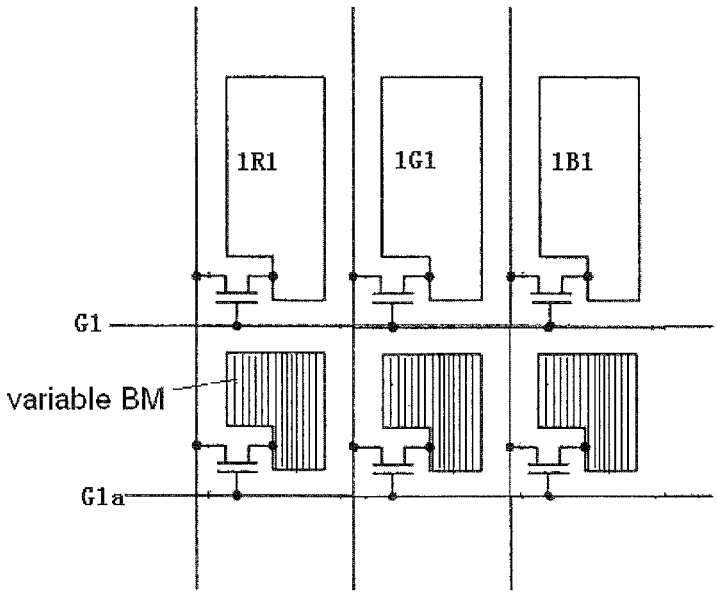
Fig. 2 (Prior Art)
FIG. 2 is another structural diagram of a liquid crystal display panel in prior arts.

Exemplary embodiments of the present invention will be described hereinafter in detail with reference to the attached drawings, wherein the like reference numerals refer to the like elements. The present invention may, however, be embodied in many different forms and should not be construed as being limited to the embodiment set forth herein; rather, these embodiments are provided so that the present invention will be thorough and complete, and will fully convey the concept of the disclosure to those skilled in the art.

Embodiments of the present invention provide a method for driving a liquid crystal display panel and a liquid crystal display so that the power consumption for driving a 3D liquid crystal display panel can be reduced.

Figure 3:
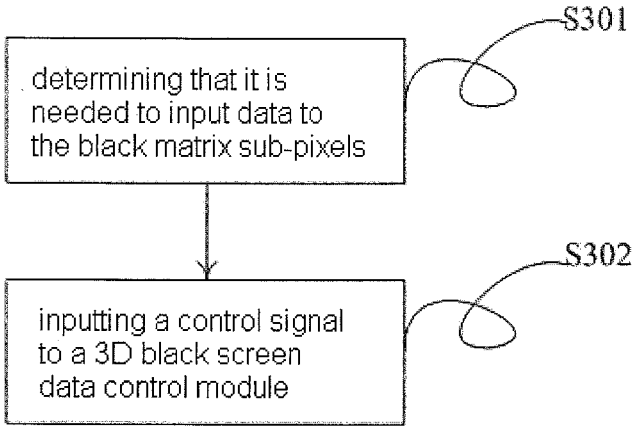
FIG. 3 is a flow chart of a method for driving a liquid crystal display panel according to a specific embodiment of the present invention.
Figure 5:
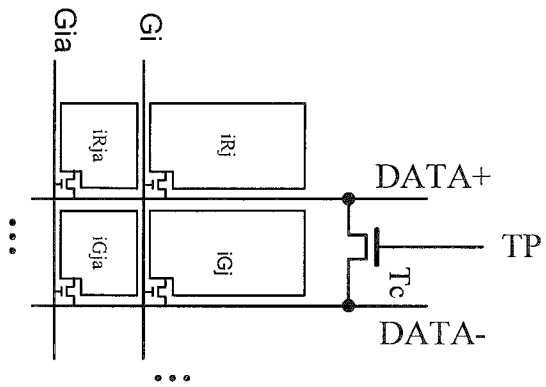
FIG. 5 is a circuit diagram of a 3D black screen data control module according to a specific embodiment of the present invention.

As shown in FIGS. 3 and 5, embodiments of the present invention provide a method for driving a liquid crystal display panel, the liquid crystal display panel including:

a plurality of rows of gate lines Gi, Gia;

a plurality of data lines arranged in columns, such as DATA+ and DATA−;

a plurality of rows of basic pixels, wherein each row of basic pixels is divided into a row consisting of black matrix sub-pixels such as iRja, iGja and a row consisting of color sub-pixels such as iRj, iGj, wherein the row consisting of black matrix sub-pixels for example is located between two adjacent gate lines, and both the black matrix sub-pixels and the color sub-pixels are connected with corresponding column of data lines and corresponding gate lines; and a 3D black screen data control module connected between two data lines, wherein, when displaying a 3D image, the method includes steps of:

S301: determining that it is needed to input data to the black matrix sub-pixels such as iRja, iGja; and S302: inputting a control signal to the 3D black screen data control module, the 3D black screen data control module, based on the received control signal, making the two data lines, which are connected therewith and are of opposite polarities, be electrically conducted.

Since the magnitude of the level obtained after the date lines are electrically conducted is close to that of the black screen data, the present invention can obtain black screen data by means of the 3D black screen data control module so as to drive the black matrix sub-pixels and thus reduce power consumption, without reversing polarities and inputting the black screen data.

There are many implementations for connection between the data lines and the 3D black screen data control module. Optionally, the 3D black screen data control module is connected with two adjacent data lines, and each data line is only connected with one 3D black screen data control module.

Optionally, the 3D black screen data control module makes the data lines be electrically conducted for a time period which is not less than that required to charge the black matrix sub-pixels.

Since voltage polarities of two adjacent data lines are opposite to each other, voltage values of the two data lines are close to the black screen data when the data lines are electrically conducted, thereby the voltages on the data lines can be inputted directly to the black matrix sub-pixels as black data voltages.

The 3D black screen data control module can be achieved by various circuits or elements. Optionally, as shown in FIG. 5, the 3D black screen data control module includes a thin film transistor, a source and a drain of which are connected to different data lines such as DATA+ and DATA−, and the step of inputting the control signal to the 3D black screen data control module includes inputting the control signal to a gate of the thin film transistor.

Optionally, after inputting the control signal to the 3D black screen data control module in S302, the method further includes inputting a compensation level signal to the black matrix sub-pixels through a corresponding data line. A sum of level values of the compensation level signal and a level signal on the data line obtained after inputting the control signal to the 3D black screen data control module satisfies a preset condition. Optionally, the preset condition is that the sum meets requirements of the black screen data. The data lines can output true black screen data by inputting the compensation level signal, thereby a higher quality 3D image can be displayed.

The liquid crystal display panel is further configured to display a 2D image, and when displaying a 2D image, the method further includes arranging every two adjacent rows of gate lines in one group and then sequentially scanning each group of gate lines, one row of gate lines in the one group of gate lines are connected to a corresponding row of color sub-pixels, the other row of gate lines in the one group of gate lines are connected with a corresponding row of black matrix sub-pixel, wherein, when scanning either group of gate lines, a 2D image signal level is inputted to the color sub-pixel and the black matrix sub-pixel which are connected with the group of gate lines.

Figure 4:
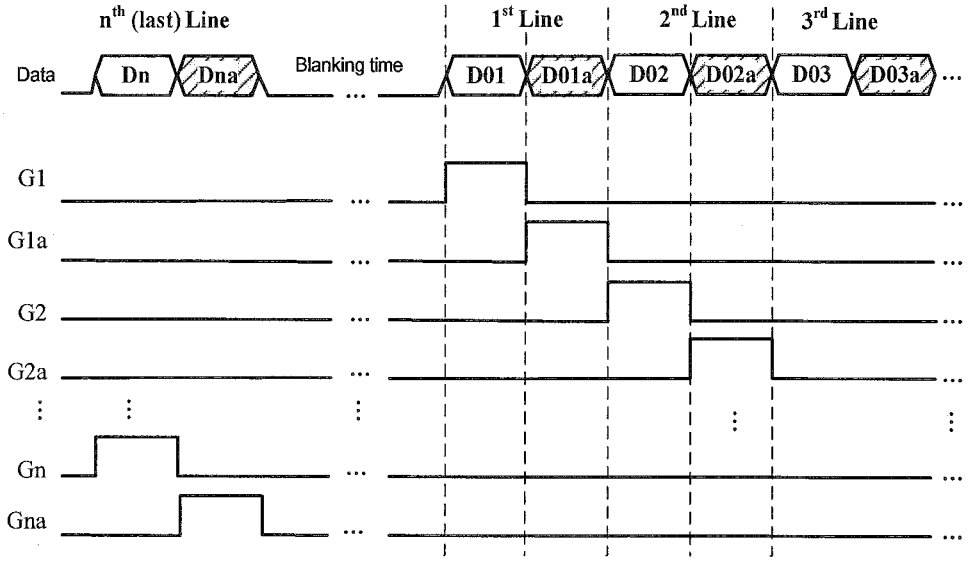
Fig. 4 (Prior Art)
FIG. 4 is a timing diagram of a liquid crystal display panel in prior arts.

When the prior art 3D display displays a 2D image, a driving mode of line by line scan is used as shown in FIG. 4. In the driving mode of line by line scan, since numbers of pixel cells are doubled, a charging time for a normal display pixel, i.e., a color sub-pixel, is half of that for a conventional 2D image display, which increases a change frequency for driving data. In contrast, according to the method of the present invention, simultaneously inputting a 2D image signal level to the color sub-pixel and the black matrix sub-pixel which are connected with one group of gate lines can simplify the driving mode of the liquid crystal display panel under the 2D mode, so that a scanning frequency can be reduced by half, thereby reducing the driving power consumption.

In the above method, optionally, when it is needed to input data to the color sub-pixels through a data line, that data line is disconnected from a corresponding 3D black screen data control module connected therewith.

Several specific embodiments of the present invention are provided below.

SPECIFIC EMBODIMENT 1

As shown in FIG. 5, a basis structure for a liquid crystal display panel according to one specific embodiment of the present invention includes a thin film transistor Tc, a positive polarity data line DATA+, a negative polarity data line DATA−, color sub-pixels iRj and iGj, variable black matrix sub-pixels (variable BM sub-pixels) iRja and iGja, a first gate line Gi and a second gate line Gia, and a data driver latch signal line, and a term "TP" is used by those skilled in the art to indicate the date driver latch signal.

A source and a drain of the thin film transistor Tc are connected to two adjacent data lines of opposite polarities respectively, and a gate of the thin film transistor Tc is connected with the TP (data driver latch signal output end) which is a charge sharing control signal.

When it is needed to generate a 3D black screen data, the thin film transistor Tc is used to make the two adjacent data lines of opposite polarities be electrically conducted so as to achieve a charge sharing effect, thus voltages on the two data lines after being electrically conducted are close to black screen data and thus are inputted to the variable BM sub-pixels iRja, iGja.

Figure 6:
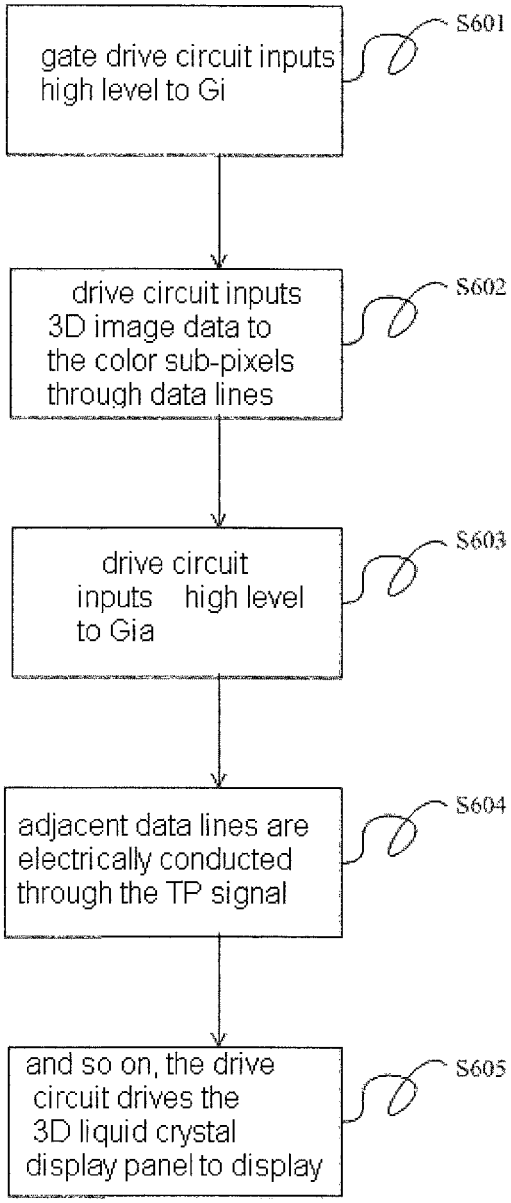
FIG. 6 is a flow chart of a method for driving a liquid crystal display panel according to a specific embodiment of the present invention.
Figure 7:
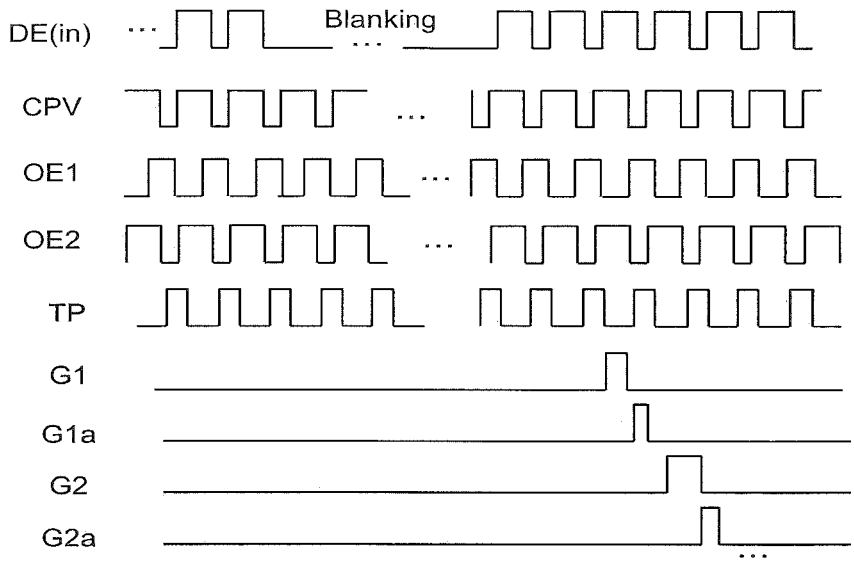
FIG. 7 is a timing diagram of a method for driving a liquid crystal display panel according to a specific embodiment of the present invention.

As shown in FIG. 6, one specific embodiment of the present invention provides a method for driving a liquid crystal display panel, including the following steps:

S601: a gate drive circuit inputs a high level to Gi (i is a natural number); wherein respective timing relationships are shown in FIG. 7;

a gate pulse enable signal OE (Output Enable) 1 becomes low and is kept for a time period, that is, for a chargeable time period for the color sub-pixels connected with Gi.

S602: a drive circuit (a source drive circuit of the drive module) inputs 3D image data to the color sub-pixels through data lines;

S603: a drive circuit (a gate drive circuit of the drive module) inputs a high level to Gia (i is a natural number);

a gate pulse enable signal OE2 becomes low after OE1 is resumed and the gate pulse enable signal OE2 is kept for a time period, that is, for a chargeable time period for the black matrix sub-pixels connected with Gia.

S604: the TP signal becomes a high level signal, so that adjacent data lines are electrically conducted; wherein, as shown in FIG. 5, adjacent gate lines DATA+ and DATA− are arranged in one group, and each data line of the two data lines connected in pair to the thin film transistor is only connected with one thin film transistor. Also as shown in FIG. 5, the two data lines connected in pair to the thin film transistor are connected with each other by one thin film transistor.

Figure 8:
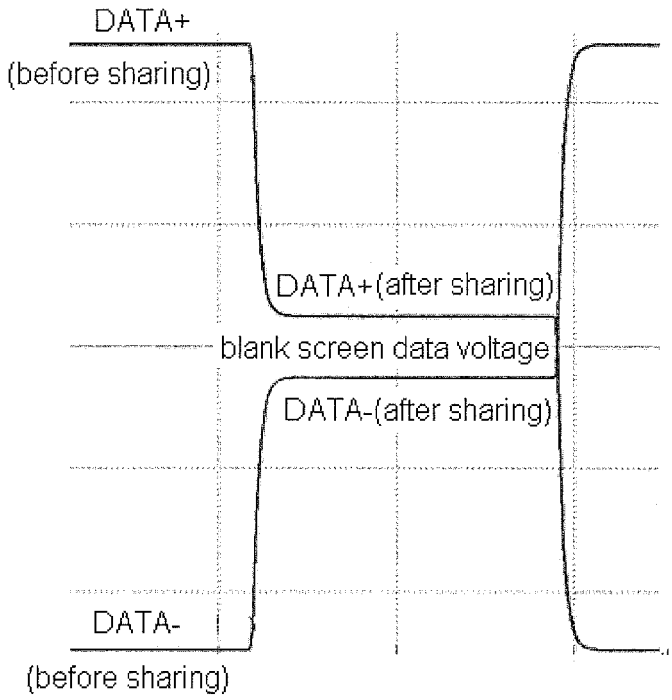
FIG. 8 is a diagram showing a change in a charge sharing level on a data line in a method for driving a liquid crystal display panel according to a specific embodiment of the present invention.

As shown in FIG. 8, after the two adjacent gate lines are electrically conducted, sharing charges on the adjacent gate lines are neutralized to obtain a lower level as the black screen data. Meanwhile, a certain level can also be inputted to a corresponding data line to adjust the black screen data so as to meet a higher requirement for the black screen data.

Electric energy is saved compared to prior arts in which the polarities are reversed and the black screen data is inputted.

S605: and so on, the drive circuit drives the liquid crystal display panel to display.

Figure 9:
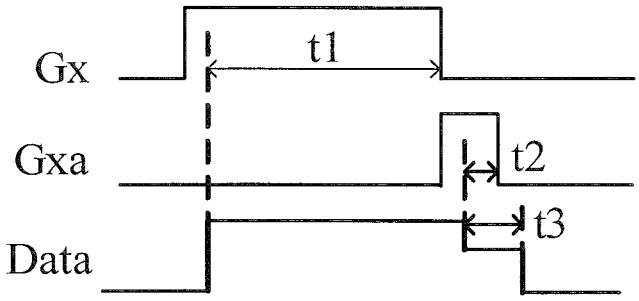
FIG. 9 is a diagram showing a relationship between levels and time in a method for driving a liquid crystal display panel according to a specific embodiment of the present invention.

As shown in FIG. 9, which is a diagram showing a level signal-time relationship of the gate lines and data lines in the above steps, wherein Gx, Gxa indicate signals on the gate line connected with the color sub-pixel and the gate line connected with the black matrix sub-pixel respectively, DATA is a data signal inputted by the drive circuit. t1 is an effective input time for 3D image data in S602, and t2 is an effective input time for data, that is, black screen data in S604, wherein t1 is not less than minimum charging time for the color sub-pixel, and t2 is not less than a time required to charge the black matrix sub-pixel. t3 is a duration for the black screen data after charge sharing, and a drop edge after t3 means polarity reversal of data lines so that a scan for next row of gate lines starts.

SPECIFIC EMBODIMENT 2

Figure 10:
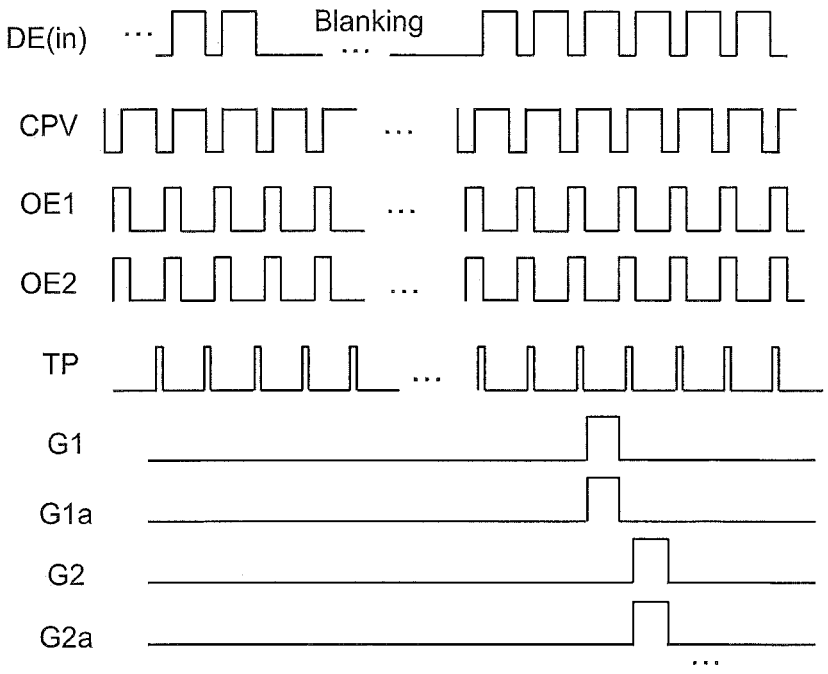
FIG. 10 is a timing diagram of a method for driving a liquid crystal display panel according to a specific embodiment of the present invention.

As shown in FIG. 10, under a 2D mode, the same timing sequence is used for gate pulse enable signals (OE1, OE2). Thus, the first gate line and the second gate line are input high levels at the same time, and input 2D image signal levels to the color sub-pixels and the black matrix sub-pixels through data lines. This driving mode reduces a scanning frequency for gate lines while increasing the pixel charging time.

Figure 11:
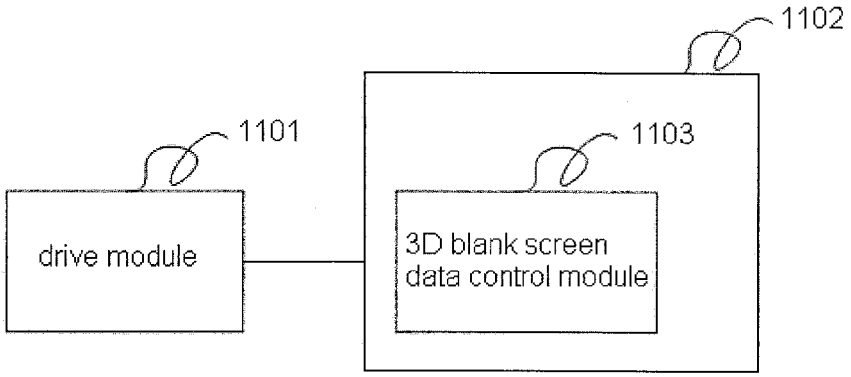
FIG. 11 is a structural diagram of a liquid crystal display panel according to a specific embodiment of the present invention.

As shown in FIG. 11, the present invention provides a liquid crystal display, including a drive module 1101 and a liquid crystal display panel 1102, wherein the liquid crystal display panel 1102 includes black matrix sub-pixels and color sub-pixels, and further includes a 3D black screen data control module 1103.

The 3D black screen data control module is arranged between data lines, and makes data lines connected therewith be electrically conducted when receiving a control signal.

The drive module is used to determine that it is needed to input data to the black matrix sub-pixels when displaying a 3D image, and is used to input the control signal to the 3D black screen data control module.

Figure 12:
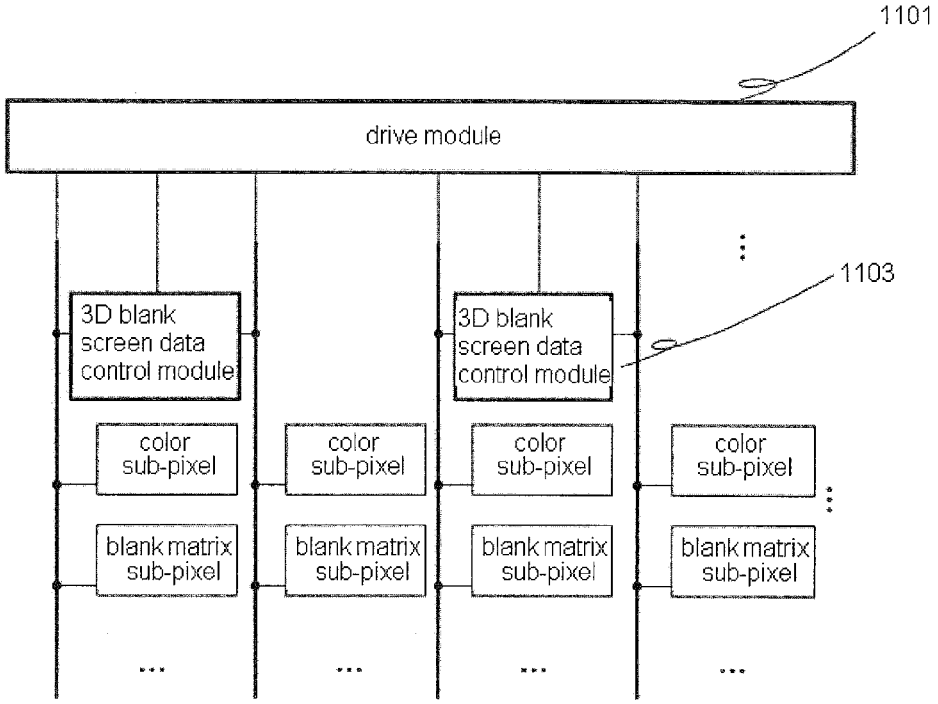
FIG. 12 is another structural diagram of a liquid crystal display panel according to a specific embodiment of the present invention.

Optionally, the 3D black screen data control module is connected with two adjacent data lines, and each data line is only connected with one 3D black screen data control module. A specific logic structure is shown in FIG. 12.

Optionally, the 3D black screen data control module includes a thin film transistor; wherein a source and a drain of the thin film transistor are connected with different data lines, and a gate thereof is connected with a TP signal output end of the drive module of the liquid crystal display panel.

Optionally, the drive module is used to input a compensation level signal to the black matrix sub-pixels as described above after inputting the control signal to the 3D black screen data control module, wherein a sum of level values of the compensation level signal and a level signal on the data line obtained after inputting the control signal to the 3D black screen data control module satisfies a preset condition.

Optionally, the drive module is further used to arrange every two adjacent rows of gate lines in one group and then sequentially scan each group of gate lines when a 2D image is displayed, wherein, when scanning either group of gate lines, a 2D image signal level is inputted to the color sub-pixel and the black matrix sub-pixel connected with the group of gate lines.

As described above, embodiments of the present invention provide a method for driving a liquid crystal display panel and a liquid crystal display so that the power consumption for driving a 3D liquid crystal display panel can be reduced.

Although several exemplary embodiments have been shown and described, it would be appreciated by those skilled in the art that various changes or modifications may be made in these embodiments without departing from the principles and spirit of the disclosure, the scope of which is defined in the claims and their equivalents.

What is claimed is:

1. A method for driving a liquid crystal display panel, the liquid crystal display panel including a plurality of rows of basic pixels, a plurality of rows of gate lines, a plurality of data lines arranged in columns, and a 3D black screen data control module, wherein each row of basic pixels is divided into a row consisting of black matrix sub-pixels and a row consisting of color sub-pixels, both the black matrix sub-pixels and the color sub-pixels are connected with corresponding column of data lines and corresponding gate lines, each 3D black screen data control module is connected between two data lines which are supplied with voltages with opposite polarities, and each data line is only connected with one 3D black screen data control module, wherein, when displaying a 3D image, the method includes steps of:

determining that it is needed to input data to the black matrix sub-pixels; and inputting a control signal to the 3D black screen data control module, the 3D black screen data control module, based on the received control signal, making the two data lines, which are connected with the 3D black screen data control module, be electrically conducted to each other while the two data lines are supplied with voltages with opposite polarities during a whole time period for displaying the 3D image, so that sharing charges on the two data lines are neutralized to obtain a lower level, which is inputted as black screen data to corresponding black matrix sub-pixels, and data lines connected with different 3D black screen data control modules are not electrically conducted to one another.

2. The method according to claim 1, wherein the 3D black screen data control module makes the data lines be electrically conducted for a time period which is not less than that required to charge the black matrix sub-pixels.

3. The method according to claim 1, wherein the 3D black screen data control module includes a thin film transistor, a source and a drain of the thin film transistor are connected to the two data lines respectively; and the step of inputting the control signal to the 3D black screen data control module includes inputting the control signal to a gate of the thin film transistor.

4. The method according to claim 1, wherein the liquid crystal display panel is further configured to display a 2D image, and when displaying a 2D image, the method further includes:

arranging every two adjacent rows of gate lines in one group and then sequentially scanning each group of gate lines, one row of gate lines in the one group of gate lines are connected to a corresponding row of color sub-pixels, the other row of gate lines in the one group of gate lines are connected with a corresponding row of black matrix sub-pixel, wherein, when scanning either group of gate lines, a 2D image signal level is inputted to the color sub-pixel and the black matrix sub-pixel which are connected with the group of gate lines.

5. A liquid crystal display including a liquid crystal display panel, the liquid crystal display panel includes:

a plurality of rows of gate lines;

a plurality of data lines arranged in columns;

a plurality of rows of basic pixels, wherein each row of basic pixels is divided into a row consisting of black matrix sub-pixels and a row consisting of color sub-pixels, both the black matrix sub-pixels and the color sub-pixels are connected with corresponding column of data lines and corresponding gate lines; and a 3D black screen data control module connected between two data lines, and configured to, when it is needed to input data to the black matrix sub-pixels, make two data lines supplied with voltages with opposite polarities, which are connected with the 3D black screen data control module, be electrically conducted to each other based on a received control signal while the two data lines are still supplied with voltages with opposite polarities during a whole time period for inputting data to the black matrix sub-pixels, so that sharing charges on the two data lines are neutralized to obtain a lower level, which is inputted as black screen data to corresponding black matrix sub-pixels, wherein each data line is only connected with one 3D black screen data control module while data lines connected with different 3D black screen data control modules are not electrically conducted to one another.

6. The liquid crystal display according to claim 5, further including a drive module, the drive module is used to input the control signal to the 3D black screen data control module based on requirement for inputting data to the black matrix sub-pixels when displaying a 3D image.

7. The liquid crystal display according to claim 6, wherein the 3D black screen data control module includes a thin film transistor, a source and a drain of the thin film transistor are connected to the two data lines respectively, and a gate of which is connected with a latch signal output end of a data driver of the drive module of the liquid crystal display.

8. The liquid crystal display according to claim 5, wherein the 3D black screen data control module is connected with two adjacent columns of data lines.

* * * * *